US008899080B1

(12) United States Patent
Derman

(10) Patent No.: US 8,899,080 B1
(45) Date of Patent: Dec. 2, 2014

(54) CINCH LOCK APPARATUS AND METHOD

(76) Inventor: Jay S Derman, Temecula, CA (US)

( * ) Notice: Subject to any disclaimer, the term of this patent is extended or adjusted under 35 U.S.C. 154(b) by 115 days.

(21) Appl. No.: 13/438,147

(22) Filed: Apr. 3, 2012

Related U.S. Application Data

(60) Provisional application No. 61/613,588, filed on Mar. 21, 2012.

(51) Int. Cl.
*E05B 73/00* (2006.01)

(52) U.S. Cl.
USPC ..... 70/14; 24/136 R; 70/18; 70/30; 70/49; 70/53; 70/58

(58) Field of Classification Search
USPC ..... 70/14–18, 30, 49, 53, 58, 233; 24/115 G, 136 K, 136 R; 292/307 R, 320, 292/325
See application file for complete search history.

(56) References Cited

U.S. PATENT DOCUMENTS

| | | | | | |
|---|---|---|---|---|---|
| 345,675 | A | * | 7/1886 | Ethridge | 24/136 R |
| 351,063 | A | * | 10/1886 | McCormick | 70/65 |
| 441,487 | A | * | 11/1890 | Harrington | 439/791 |
| 928,367 | A | * | 7/1909 | De Witt | 24/134 L |
| 1,475,256 | A | * | 11/1923 | Belair | 70/18 |
| 1,987,737 | A | * | 1/1935 | Goddard | 292/307 R |
| 2,190,661 | A | * | 2/1940 | Hauer | 70/49 |
| 2,469,592 | A | * | 5/1949 | Byer | 70/174 |
| 3,593,549 | A | * | 7/1971 | Lakins et al. | 70/164 |
| 3,987,653 | A | * | 10/1976 | Lyon et al. | 70/19 |
| 4,506,417 | A | * | 3/1985 | Hara | 24/115 G |
| 4,869,084 | A | * | 9/1989 | Mack, Jr. | 70/259 |
| 4,964,419 | A | * | 10/1990 | Karriker | 128/879 |
| 5,020,342 | A | * | 6/1991 | Doan et al. | 70/14 |
| 5,035,126 | A | * | 7/1991 | Biba | 70/18 |
| 5,066,049 | A | * | 11/1991 | Staples | 285/80 |
| 5,184,798 | A | * | 2/1993 | Wilson | 248/551 |
| 5,351,507 | A | * | 10/1994 | Derman | 70/18 |
| 5,517,835 | A | * | 5/1996 | Smith | 70/14 |
| 5,791,170 | A | * | 8/1998 | Officer | 70/49 |
| 5,823,020 | A | * | 10/1998 | Benda | 70/18 |
| 5,992,187 | A | | 11/1999 | Derman | |
| 6,003,348 | A | * | 12/1999 | McCrea | 70/18 |
| 6,081,974 | A | | 7/2000 | McDaid | |
| 6,159,025 | A | | 12/2000 | Derman | |
| 6,167,734 | B1 | * | 1/2001 | Derman | 70/18 |
| 6,317,936 | B1 | | 11/2001 | McDaid | |
| 6,360,405 | B1 | | 3/2002 | McDaid | |

(Continued)

OTHER PUBLICATIONS

Reese Towpower 7006000 Stainless Steel Dual Bent Pin Receiver Lock, http://www.amazon.com, pp. 1-5, accessed Aug. 31, 2011.

(Continued)

*Primary Examiner* — Lloyd Gall
(74) *Attorney, Agent, or Firm* — Aaron P. McGushion

(57) ABSTRACT

A system for securing an item is disclosed. The system may include a length of flexible cable, a connector, and a lock. The connector may selectively connect a first portion of the cable and a second portion of the cable to form a loop in the cable. The connector may comprise a base comprising a first aperture containing the first portion of the cable and a corner. The connector may further comprise a blocker. The blocker may occupy a blocking position wherein the blocker cooperates with the base to maintain the second portion bent around the corner. The lock may selectively secure the blocker with respect to the base and maintain the blocker in the blocking position.

14 Claims, 8 Drawing Sheets

(56) References Cited

U.S. PATENT DOCUMENTS

| | | | | |
|---|---|---|---|---|
| D457,802 | S | 5/2002 | Meekma et al. | |
| D469,332 | S | 1/2003 | Meekma et al. | |
| 6,609,399 | B1 * | 8/2003 | Daniels, Jr. | 70/49 |
| 6,629,440 | B1 | 10/2003 | Meekma et al. | |
| 6,672,115 | B2 | 1/2004 | Wyers | |
| 6,755,054 | B2 | 6/2004 | Burmesch et al. | |
| 6,793,081 | B1 | 9/2004 | Derman | |
| 7,021,091 | B2 * | 4/2006 | Leyden et al. | 70/18 |
| 7,165,426 | B2 | 1/2007 | Wyers | |
| 7,204,107 | B2 * | 4/2007 | Leyden et al. | 70/18 |
| 7,225,649 | B2 | 6/2007 | Wyers | |
| 7,434,425 | B2 * | 10/2008 | Mahre et al. | 70/18 |
| 7,784,313 | B2 * | 8/2010 | Wyers | 70/49 |
| 7,997,106 | B2 | 8/2011 | Mahaffey et al. | |
| 8,001,812 | B2 | 8/2011 | Mahaffey et al. | |
| D646,951 | S | 10/2011 | Tsai | |
| 8,234,757 | B2 * | 8/2012 | Lesley | 24/68 CD |
| 2004/0074055 | A1 * | 4/2004 | Watabe | 24/115 G |
| 2005/0092037 | A1 | 5/2005 | Meekma et al. | |
| 2005/0262904 | A1 * | 12/2005 | Ling et al. | 70/49 |
| 2006/0075794 | A1 * | 4/2006 | Ling et al. | 70/58 |
| 2006/0085952 | A1 * | 4/2006 | Kaneko et al. | 24/3.1 |
| 2011/0061427 | A1 | 3/2011 | Mahaffey et al. | |
| 2011/0089794 | A1 | 4/2011 | Mahaffey et al. | |

OTHER PUBLICATIONS

Cinch-Lock Cable-Hasp, http://www.accuform.com, pp. 1-3, accessed May 9, 2012.

Master Lock Cable Locks, http://www.masterlock.com pp. 1-2, accessed May 9, 2012.

* cited by examiner

CINCH LOCK APPARATUS AND METHOD

RELATED APPLICATIONS

This application claims the benefit of U.S. Provisional Patent Application Ser. No. 61/613,588 filed Mar. 21, 2012, which is hereby incorporated by reference.

BACKGROUND

1. The Field of the Invention

This invention relates to security systems and, more particularly, to novel systems and methods for securing personal property.

2. The Background Art

As computers, expensive electronic equipment, and other valuable portable articles have become more common, theft of such articles has increased. There are a number of different devices on the market to deter such theft. However, most of these devices are quite specific in their application and cannot be applied to a wide variety of items or in certain situations. Accordingly, what is needed is an improved system and method for securing valuable portable articles of various configurations and in different situations.

BRIEF SUMMARY OF THE INVENTION

In view of the foregoing, in accordance with the invention as embodied and broadly described herein, a method and apparatus are disclosed in one embodiment of the present invention as including a system protecting an item from theft, unwanted removal, unauthorized use, or the like. In selected embodiments, a system may include an elongated member, a connector, and a lock. An elongated member may be strong yet flexible and may extend around an item that is to be secured. A connector may securely connect or link one portion of an elongate member to another portion of the elongate member to form a loop therein. By manipulating a connector, a user may control the size of the loop and how tightly a loop encircles an item.

In selected embodiments, a connector may include base and a blocker. A blocker may be transitioned by a user between one or more blocking positions and one or more non-blocking positions. In a blocking position, a blocker may resist certain motion of an elongated member within a connector. For example, in a blocking position, a blocker may resist forces urging an increase to the size of a loop. A lock may selectively control the motion of a blocker with respect to a base. Thus, a lock may secure a blocker in a blocking position.

A base may secure or engage a first portion of an elongated member in any suitable manner. In selected embodiments, a base may include a first aperture configured to receive a first portion of an elongated member. A base may further include a second aperture and an engagement mechanism. A second aperture may be configured to receive a second portion of an elongated member. An engagement mechanism may be positioned proximate a second aperture and configured to selectively engage the second portion.

In selected embodiments, an engagement mechanism may comprise a corner and the second portion may be urged against an edge of the corner by bending the second portion over or around the corner. The resistance of the second portion to such bending may ensure a firm engagement between the corner and the second portion. A blocker may be selectively positionable to maintain a second portion bent around an engagement mechanism.

In certain embodiments, a base may include a locking aperture and a blocker may be configured as a pin sized to fit therewithin. Accordingly, a connector may be moved along an elongated member until a loop of the desired size is achieved. The second portion may then be bent over the engagement mechanism and the blocker may be inserted within the locking aperture. Once inserted within the locking aperture, the blocker may occupy a blocking position and maintain the bent elongated member in contact with the engagement mechanism. Finally, a lock may be applied to secure the blocker within the locking aperture.

In other embodiments, a connector may have a generally cylindrical shape. A base may form a cylindrical core and a blocker form a cylindrical sleeve. In operation, a blocker may slide up and down over a base. One or more positions proximate one end of the range of motion may comprise or form blocking positions. One or more positions proximate an opposite end of the range of motion may comprise of form non-blocking positions.

One end of a base may have an extension extending therefrom. A locking aperture may be formed in a blocker to receive the extension therewithin when the blocker is in a blocking position. Accordingly, once the extension has been inserted through the locking aperture, a lock may be applied to the extension, thereby resisting removal of the extension from the aperture. Thus, the blocker may be secured in a blocking position.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF SELECTED EMBODIMENTS

Figure 1:
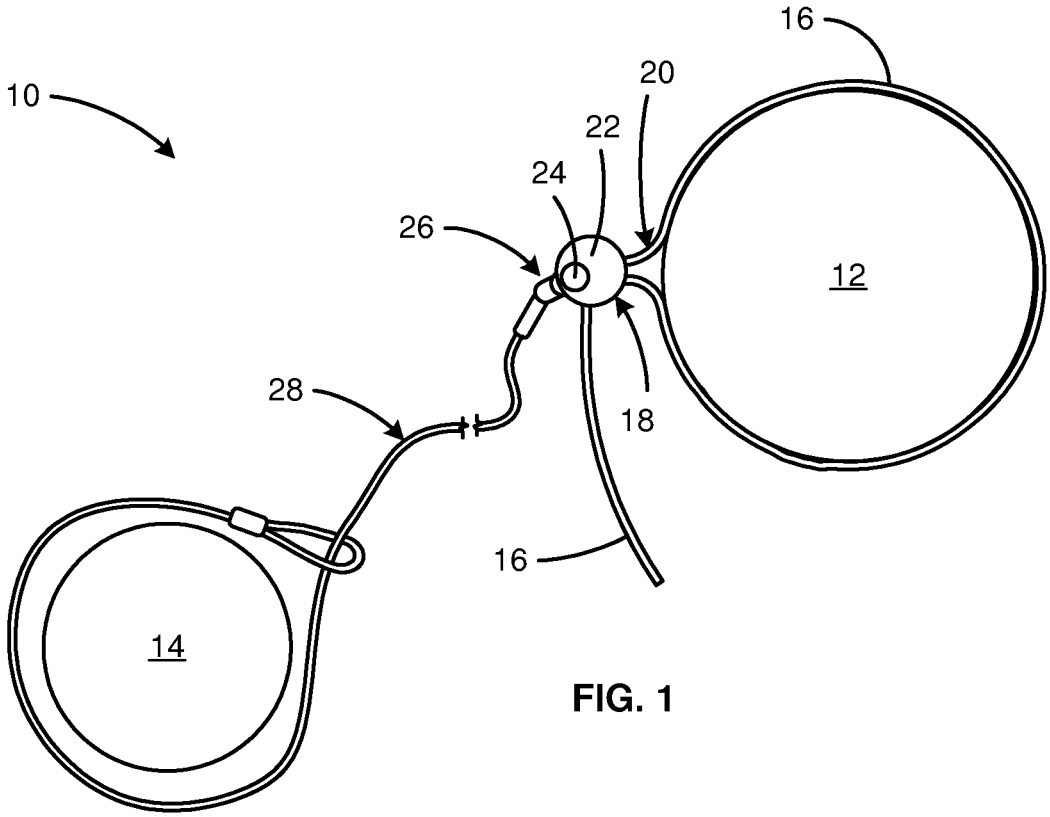
FIG. 1 is a top view of one embodiment of a system for engaging an item and tethering the item to anchor in accordance with the present invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Figure 2:
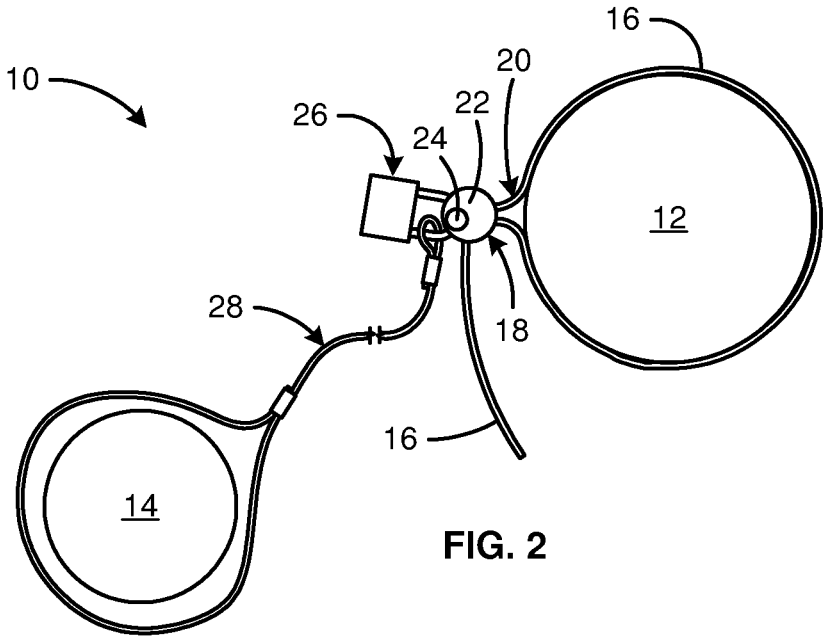
FIG. 2 is a top view of another embodiment of a system for engaging an item and tethering the item to anchor in accordance with the present invention.

Referring to FIGS. 1 and 2, a system 10 in accordance with the present invention may protect an item 12 (e.g., valuable portable article, hand tool, power tool, container, computer monitor, laptop computer, or the like) from theft, unwanted removal, unauthorized use, or the like. This may be accomplished by binding or securing an item 12 in a manner that resists use or removal of the item 12 (e.g., securing a laptop in a closed configuration, securing a container in a closed configuration, etc.). Alternatively, or in addition thereto, a system 10 may protect an item 12 by tethering or otherwise connecting an item 12 to an anchor 14.

An anchor 14 may be an object that is substantially fixed in place (e.g., an embedded post or the like). Alternatively an anchor 14 may be an object sufficiently heavy, bulky, or both to rendering moving the object unpractical or undesirable. For example, an anchor 14 may comprise a desk, table, or the like that may be moved or dismembered, but only with significant effort or with the generation of unwanted attention from surrounding individuals.

In selected embodiments, a system 10 in accordance with the present invention may include an elongated member 16. An elongated member 16 may be strong yet flexible. Accordingly, an elongate member 16 may loop around an item 12 that is to be secured. In selected embodiments, an elongate member 16 may comprise a length of cable formed of a metal or metal alloy. The cable may be coated or covered with a polymeric material to facilitate handling thereof or to prevent unwanted abrasion caused by the cable.

A system 10 may further include a connector 18. A connector 18 may securely connect or link one portion of an elongate member 16 to another portion of the elongate member 16 to form a loop 20 in the elongate member 16. A loop 20 so formed may be used to encircle an item 12 or some portion thereof. A connector 18 may enable a user to control which portion or portions of an elongate member 16 are engaged by the connector 18. Accordingly, by manipulating a connector 18, a user may control the size of a loop 20 formed by the elongate member 16 and how tightly a loop 20 encircles an item 12.

In selected embodiments, a connector 18 may include base 22 and a blocker 24. A blocker 24 may be configured to selectively move with respect to a base 22. For example, a blocker 24 may be transitioned by a user between one or more blocking positions and one or more non-blocking positions. In a blocking position, a blocker 24 may resist certain motion of an elongated member 16 or portion thereof within a connector 18. For example, in a blocking position, a blocker 24 may resist forces urging an increase to the size of a loop 20. Conversely, in a non-blocking position, a blocker 24 may provide little or no resistance to forces urging a change in the size of a loop 20.

In certain embodiments, a system 10 may further include a lock 26. A lock 26 may selectively control certain operations or movements of a connector 18 or one or more components thereof. For example, in selected embodiments, a lock 26 may selectively control the motion of a blocker 24 with respect to a base 22. Thus, a lock 26 may secure a blocker 24 in a blocking position.

A lock 26 in accordance the present invention may have any suitable form. The form of the lock 26 may vary depending on the configuration of the connector 18 or components thereof. In certain embodiments (see e.g., FIG. 1), a lock 26 or a lock 26 and tether 28 combination and may be configured as or comprise a device currently being sold by Kensington Computer Products Group under the CLICKSAFE trademark. In other embodiments (see e.g., FIG. 2), a lock 26 may comprise a padlock. In still other embodiments, a system 10 in accordance with the present invention may utilize other kinds of locks 26.

In selected embodiments, a system 10 may include a tether 28. A tether 28 may complete a link between an item 12 and an anchor 14. A tether 28 may comprise chain, cable, or the like. In selected embodiments, a tether 28 may secure to a lock 26 (e.g., engage or loop through or around a shackle of a lock 26) and extend therefrom to engage (e.g., loop through or around) an anchor 14.

The various components of a system 10 in accordance with the present invention may be formed of any suitable materials. Suitable materials may be selected to provide a desired durability, strength, rigidity, toughness, or the like. For example, in selected embodiments, one or more of the components of a system 10 may be formed of a polymeric material. However, in other embodiments where greater stresses are expected, such components may be formed of a metal or metal alloy.

Figure 3:
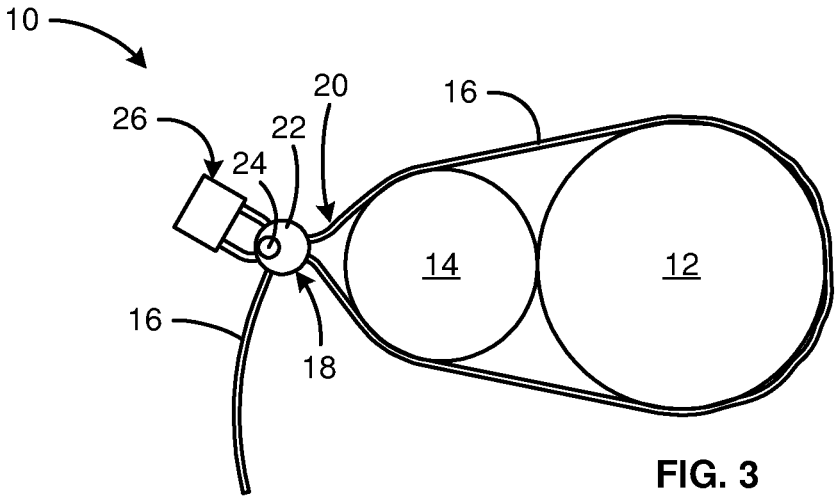
FIG. 3 is a top view of one embodiment of a system for securing an item directly to an anchor in accordance with the present invention.

Referring to FIG. 3, in certain embodiments, a tether 28 may be omitted. For example, in selected embodiments, a loop 20 of an elongated member 16 may encircle both an item 12 to be secured or portion thereof and an anchor 14 or portion thereof. Accordingly, an elongated member 16 may directly tie an item 12 to an anchor 14. Alternatively, a tether 28 may be omitted simply because the loop 20 of an elongate member 16 may be all the security necessary or desired. That is, a user may simply desire to maintain an item 12 in a compacted, closed, or unusable configuration, not to tether the item 12 to an anchor 14. In such embodiments, both a tether 28 and an anchor 14 may be omitted from a system 10 in accordance with the present invention.

Figure 4:
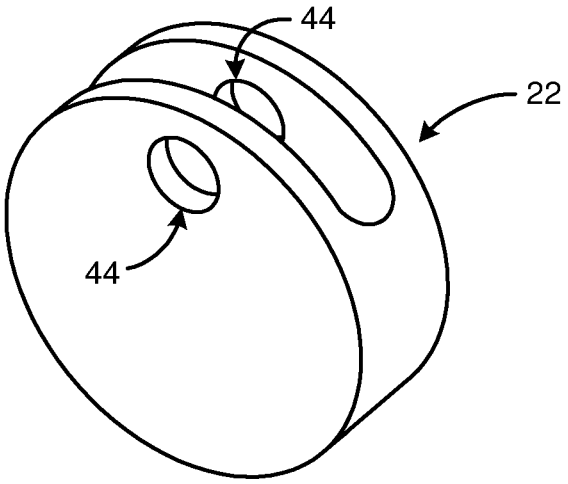
FIG. 4 is a perspective view of one embodiment of a base of a connector in accordance with the present invention.
Figure 5:
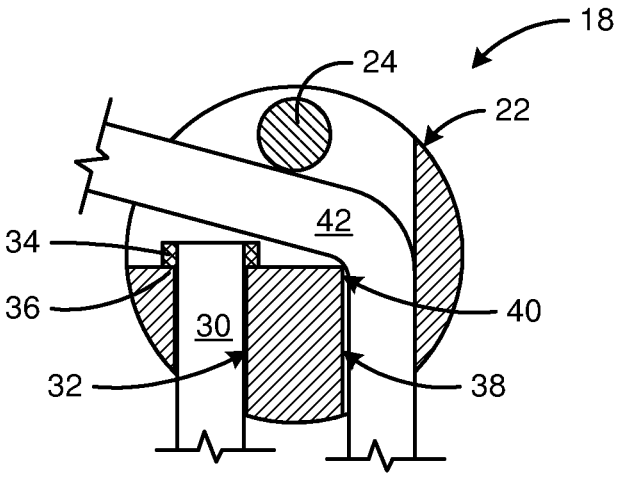
FIG. 5 is a cross-sectional view of one embodiment of a connector in accordance with the present invention comprising the base of FIG. 4.
Figure 6:
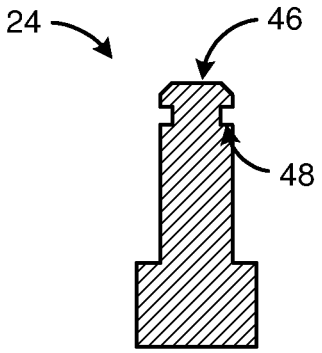
FIG. 6 is a cross-section view of one embodiment of a blocker in accordance with the present invention suitable for use in connection with the connector of FIG. 4.
Figure 7:
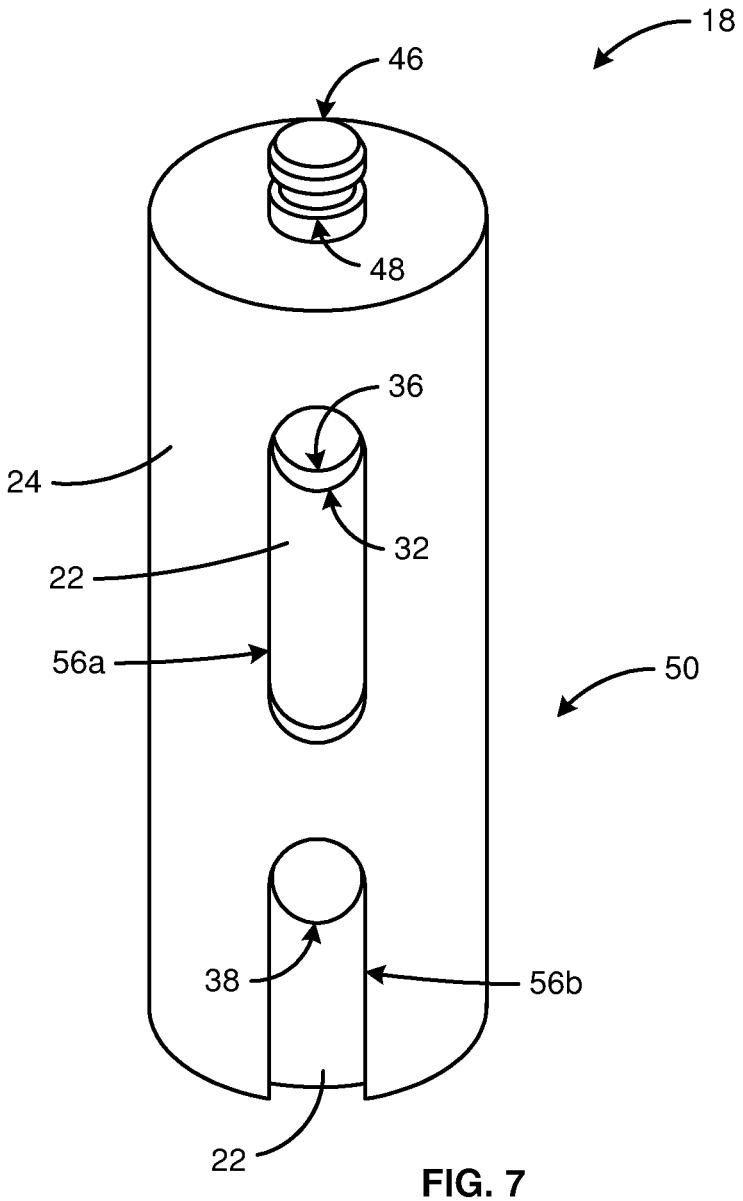
FIG. 7 is a perspective view of another embodiment of a connector in accordance with the present invention with the blocker in a blocking position and no elongated member installed.
Figure 8:
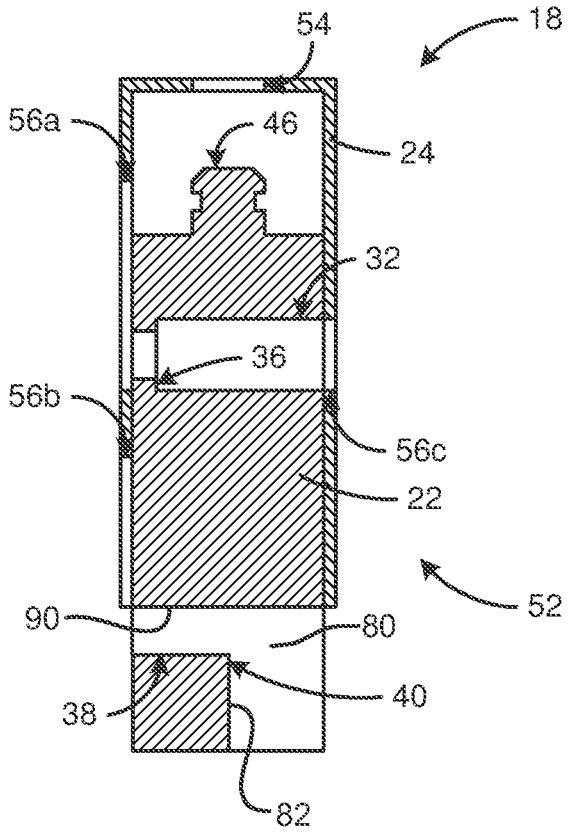
FIG. 8 is a cross-sectional view of the connector of FIG. 7 with the blocker in a non-blocking position.
Figure 9:
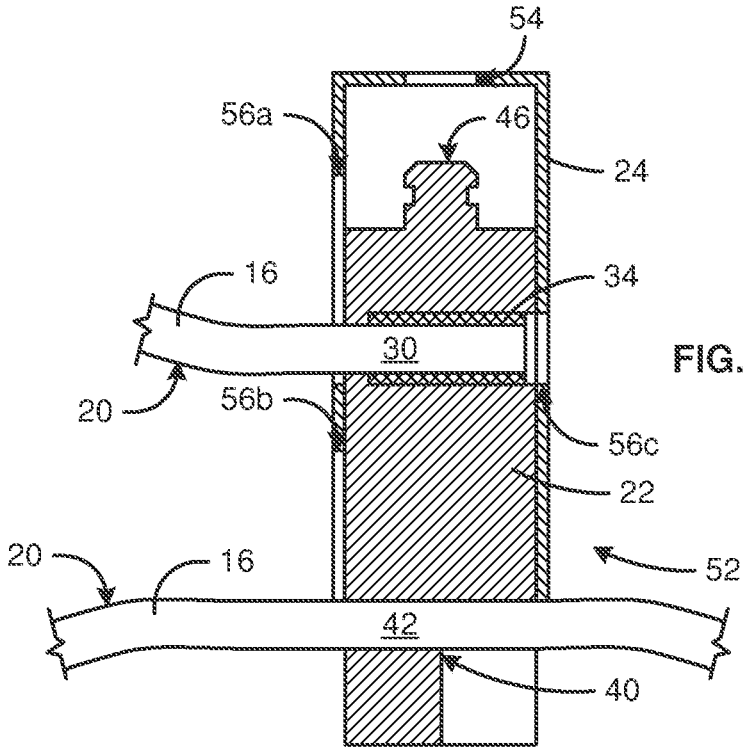
FIG. 9 is a cross-sectional view of the connector of FIG. 7 with the blocker in a non-blocking position and an elongated member installed.
Figure 10:
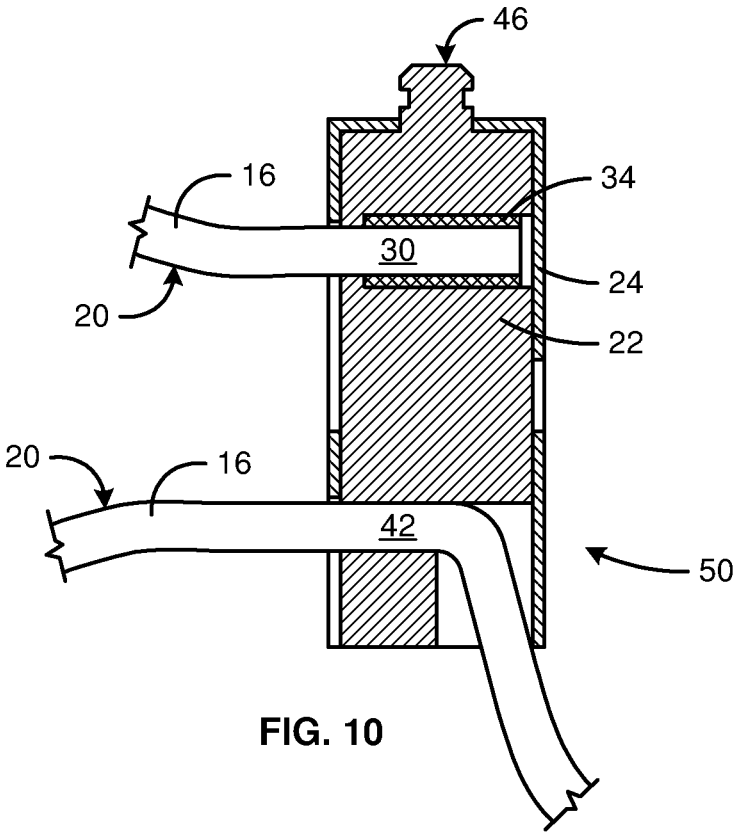
FIG. 10 is a cross-sectional view of the connector of FIG. 7 with an elongated member installed and the blocker in a blocking position.

Referring to FIGS. 4 and 5, a base 22 may secure or engage a first portion 30 of an elongated member 16 in any suitable manner. Suitable securement may include crimping, pinning, clamping, bonding, welding, camming, wedging, or the like. Securement or engagement between a base 22 and first portion 30 may be directionally specific. For example, in selected embodiments, a base 22 may include a first aperture 32 configured to receive a first portion 30 of an elongated member 16. A first portion 30 may include a collar 34 or band 34 connected thereto. The collar 34 may abut a shoulder 36 formed within a base 22 (e.g., as part of a first aperture 32) and resist movement urging such abutment. However, the first portion 30 may be free to move at least some distance in an opposite direction.

In selected embodiments, a base 22 may include a second aperture 38 and an engagement mechanism 40. A second aperture 38 may be configured to receive a second portion 42 of an elongated member 16. An engagement mechanism 40 may be positioned proximate a second aperture 38 and configured to selectively engage the second portion 42. In certain embodiments, the engagement produced by an engagement mechanism 40 may depend on the position of the second portion 42 with respect thereto.

For example, in selected embodiments, an engagement mechanism 40 may comprise one or more edges or teeth configured to bite into or otherwise grip a second portion 42. An engagement may be accomplished by urging the one or more edges and the second portion 42 together. In certain embodiments, an engagement mechanism 40 may comprise a corner and the second portion 42 may be urged against an edge of the corner by bending the second portion 42 over or around the corner. The resistance of the second portion 42 to such bending may ensure a firm engagement between the corner and the second portion 42.

An engagement mechanism 40 configured as a corner may have any suitable geometry. In selected embodiments, a corner (when viewed in cross-section) may form an acute, right, or obtuse angle. An edge of a corner may be relatively sharp. Alternatively, an edge of a corner may be chamfered, curved, radiused, or otherwise softened to some degree. An edge of a corner may be linear. Alternatively, an edge may be non-linear. For example, in selected embodiments, an edge may follow an intersection of two surfaces, one or both of which may be non-planar surfaces (e.g., one flat surface and another cylindrical surface forming part of a second aperture 38).

A blocker 24 may be selectively positionable to secure a second portion 42 in contact with an engagement mechanism 40. In selected embodiments, a blocker 24 in a blocking position may maintain a second portion 42 bent around an engagement mechanism 40. For example, in certain embodiments, a base 22 may include a locking aperture 44. A blocker 24 may be configured as a pin sized to fit within the locking aperture 44. Accordingly, a connector 18 may be moved along an elongated member 16 (with the elongated member 16 sliding through a second aperture 38) until a loop 20 of the desired size is achieved and a desired portion 42 of the elongated member 16 is positioned within the connector 18. At that point, the second portion 42 may be bent over the engagement mechanism 40 and the blocker 24 may be inserted within the locking aperture 44. Once inserted within the locking aperture 44, the blocker 24 may occupy a blocking position and maintain the bent elongated member 16 in contact with the engagement mechanism 40. Finally, a lock 26 may be applied to secure the blocker 24 within the locking aperture 44.

Referring to FIGS. 6-10, in selected embodiments, one of a base 22 and blocker 24 may include an extension 46 extending therefrom. An extension 46 may provide a mechanism through which a lock 26 may secure a blocker 24 in a blocking position. An extension 46 in accordance with the present invention may have any suitable configuration. In certain embodiments, an extension 46 may be configured as an anchor disclosed in U.S. Pat. No. 6,081,974 issued Jul. 4, 2000, U.S. Pat. No. 6,317,936 issued Nov. 20, 2001, or U.S. Pat. No. 6,360,405 issued Mar. 26, 2002, each of which is hereby incorporated by reference. Alternatively, an extension 46 may be configured as an attachment device disclosed in U.S. Pat. No. 7,997,106 issued Aug. 16, 2011 or U.S. Pat. No. 8,001,812 issued Aug. 23, 2011, both of which are hereby incorporated by reference. In still other embodiments, an extension 46 may be configured as an interface mechanism disclosed in U.S. patent application Ser. No. 13/216,076 filed Aug. 23, 2011, which is hereby incorporated by reference.

In selected embodiments, an extension 46 may include one or more mechanisms or structures enabling a lock 26 to engage therewith. For example, an extension 46 may include a locking groove 48 enabling a lock 26 to selectively grip a corresponding extension 46. In certain embodiments, a locking groove 48 may extend circumferentially about an extension 46. Such a locking groove 48 may enable a lock 26 to pivot about the corresponding extension 46, while maintaining a secure engagement therewith.

In certain embodiments, to engage an extension 46, a lock 26 may be configured as or comprise a device disclosed in U.S. Pat. No. 6,081,974, U.S. Pat. No. 6,317,936, U.S. Pat. No. 6,360,405, U.S. Pat. No. 7,997,106, or U.S. Pat. No. 8,001,812. For example, as stated hereinabove, a lock 26 or a lock 26 and tether 28 combination and may be configured as or comprise a device currently being sold by Kensington Computer Products Group under the CLICKSAFE trademark.

In selected embodiments, a blocker 24 may include an extension 46. For example, in selected embodiments, a blocker 24 may comprise a pin extending through a locking aperture 44 formed in a base 22. One end of the pin may form a head, while an opposite end forms an extension 46. Accordingly, a lock 26 may engage the extension 46 and resist removal of the blocker 24 from the locking aperture 44.

Alternatively, an extension 46 may be included as part of a base 22. For example, in selected embodiments, a connector 18 may have a generally cylindrical shape and define axial, radial, and circumferential directions. A base 22 or portion thereof may have a cylindrical shape and be referred to as a cylindrical base or a cylindrical core. Similarly, a blocker 24 or portion thereof may have a cylindrical shape and be referred to as a cylindrical sleeve. The base 22 may have a cutout or a stepped area 80 defined by a back wall 82, a bottom wall 90, and a through hole or second aperture 38. The through hole 38 is formed through the back wall 82 with a transition portion or engagement mechanism 40 formed between the back wall 82 and the through hole 38.

In operation, a blocker 24 may move through a range of motion with respect to a base 22. For example, a blocker 24 may slide up and down over a base 22. One or more positions proximate one end of the range of motion may comprise or form blocking positions 50. One or more positions proximate an opposite end of the range of motion may comprise of form non-blocking positions 52.

One end of a base 22 may have an extension 46 extending therefrom (e.g., in an axial direction). A locking aperture 54 may be formed in a blocker 24 to receive the extension 46 therewithin when the blocker 24 is in a blocking position 50. Accordingly, once the extension 46 has been inserted through the locking aperture 54, a lock 26 may be applied to the extension 46, thereby resisting removal of the extension 46 from the aperture 54. Thus, the blocker 24 may be secured in a blocking position 50.

In selected embodiments, a blocker 24 may have various apertures 56 or slots 56 formed therein to accommodate various portions of an elongated member 16. For example, a first aperture **56*a* may accommodate a first portion 30 of an elongated member 16 as it exits a base 22. In selected embodiments, a first aperture 56*a* may have a closed perimeter and form one limit on the range of motion of a blocker 24 with respect to a base 22. A second aperture 56*b* may accommodate a second portion 42 of an elongated member 16 as it exits a base 22. A third aperture 56***c* may be included and provide an opening for loading the first portion 30 of the elongated member 16 into the first aperture 32.

In certain embodiments, a loop 20 may extend exclusively from one side of a connector 18. Alternatively, one end of a loop 20 may extend from one side of a connector 18, while the other end of the loop 20 extends from a different side (e.g., an opposite side) of the connector 18. In the illustrated embodiment, the latter may be accomplished by positioning the second aperture 38 and corresponding aperture 56*b* on the opposite side of the connector 18.

Figure 11:
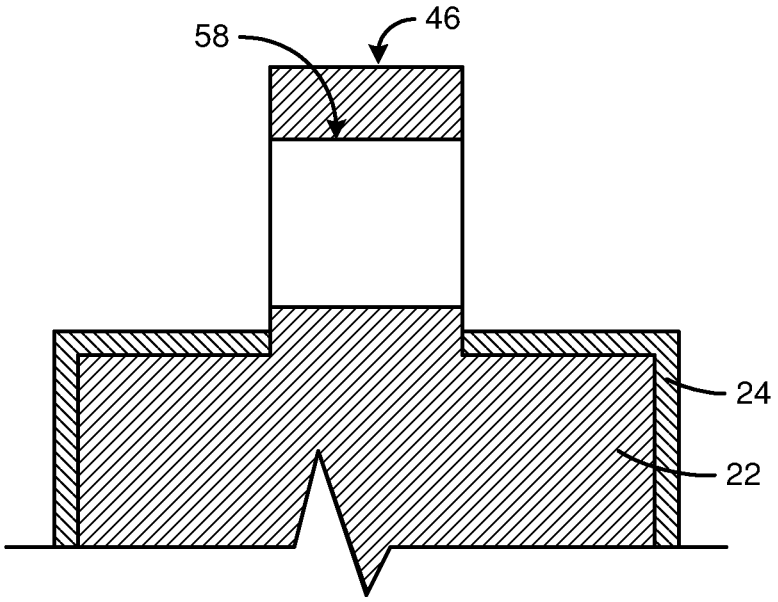
FIG. 11 is a cross-section view of an alternative embodiment of an extension in accordance with the present invention, the extension having a shackle aperture formed therein.

Referring to FIG. 11, an extension 46 need not include a locking groove 48. For example, in selected embodiments, an extension 46 may include a shackle aperture 58 rather than a locking groove 48. A shackle aperture 58 may be configured to receive the shackle of a lock 26 therewithin. Once a shackle has been inserted and secured within a shackle aperture 58, the shackle may resist removal of the extension 46 from the locking aperture 54. Thus, the blocker 24 may be secured in a blocking position 50.

Figure 12:
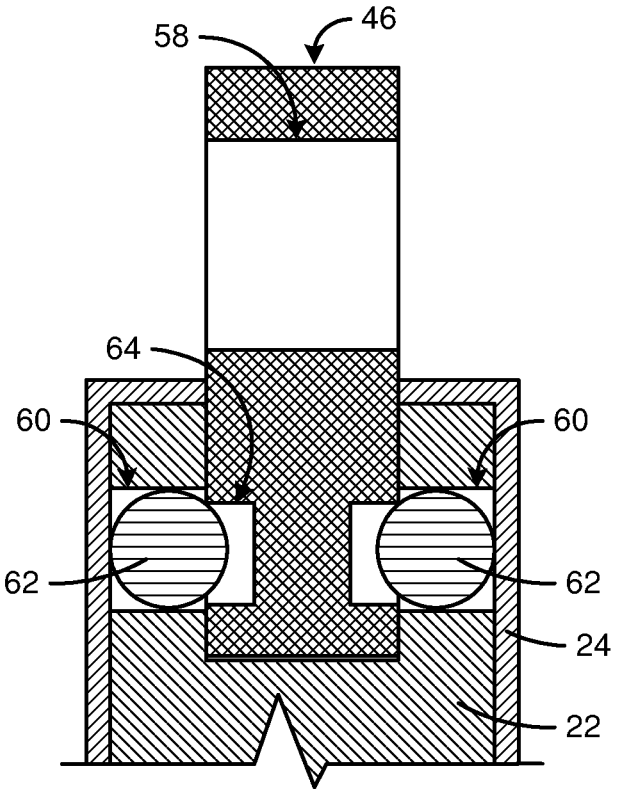
FIG. 12 is a cross-section view of an alternative embodiment of an extension in accordance with the present invention, the extension being configured to pivot with respect to the rest of a connector.

Referring to FIG. 12, in certain embodiments, an extension 46 may be configured to pivot. For example, an extension 46 may be configured to pivot with respect to a base 22 and blocker 24 about an axis extending in the axial direction. Such pivoting may be provided in any suitable manner.

In selected embodiments, a base 22 may include one or more interference apertures 60. Each interference aperture 60 may contain, or partially contain, a corresponding interference member 62. Each interference member 62 may extend from a corresponding interference aperture 60 to engage an extension 46. For example, each interference member 62 may extend from a corresponding interference aperture 60 into a groove 64 of an extension 46. The resulting system may resist inadvertent removal of an extension 46, while still permitting the extension 46 to pivot as desired.

The interface between an extension 46 and a base 22 may include a plurality of interference members 62 and corresponding interference apertures 60. In selected embodiments, the number of interface mechanisms 62 may be selected to distribute the loads applied thereby to a corresponding extension 46. Such distribution may lower the stress imposed on the extension 46, interference members 62, base 22, and the like. It may also balance such loading. In selected embodiments, two or three interference members 62, each contained within a corresponding interference aperture 60, uniformly distributed in a circumferential direction about an extension 46 may be sufficient.

A blocker 24 may assist in maintaining one or more interference members 62 in engagement with the corresponding groove 64. For example, in a blocking position 50, a blocker 24 may block an interference member 62 from moving out of engagement with an extension 46 (e.g., out of engagement with a groove 64 of an extension 46). Accordingly, when a blocker 24 is in a blocking position 50, an extension 46 may be securely held in place. However, when a blocker 24 is removed, an interference member 62 may move out of engagement with an extension 46 (e.g., out of engagement with a groove 64 of an extension 46). Accordingly, when a blocker 24 is removed, an extension 46 may also be removed.

Figure 13:
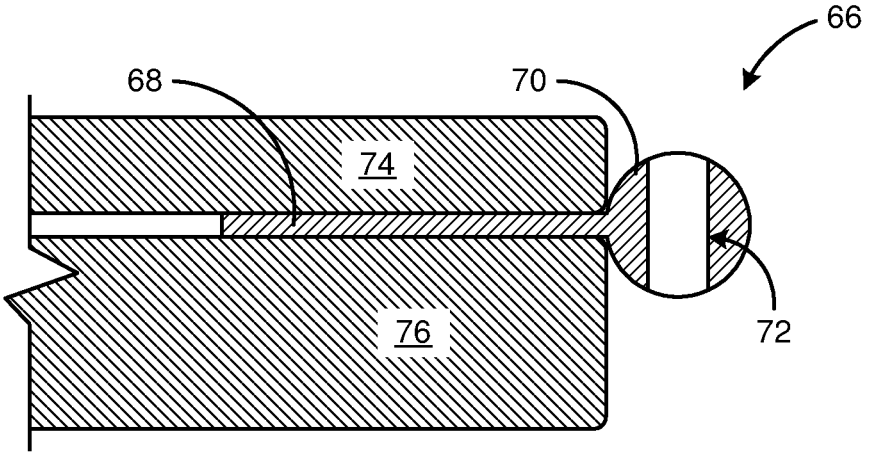
FIG. 13 is a cross-sectional view of a centering device applied to a laptop in accordance with the present invention.

Referring to FIG. 13, in selected embodiments, a system 10 in accordance with the present invention may be used in conjunction with one or more accessories. The accessories may be configured to expand the number of situations in which a system 10 may be successfully used. For example, in certain embodiments, a system 10 may be used in conjunction with a laptop centering device 66. Such a device 66 may prevent an elongated member 16 from sliding off an end of a laptop after it has been tightened and secured about a closed laptop.

A centering device 66 may have any suitable configuration. In selected embodiments, such device may include a flange 68, a bumper 70, and an aperture 72. A flange 68 may extend between a screen 74 and main body 76 of a laptop at a location between the screen hinges. A bumper 70 may abut an edge of the screen 74 and main body 76 and prevent the flange from rotating out from between the screen 74 and main body 76. The aperture 72 may be sized to received an elongated member 16 therebetween. Once a centering device 66 is inserted in place and an elongated member 16 is passed therethrough, tightened, and locked, the centering device 66 may prevent the elongated member 16 from being slid off the laptop. That is, the hinges of the laptop may limit the side-to-side motion of the centering device 66 and the centering device 66 may, therefore, limit the side-to-side motion of the elongated member 16.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A securement device configured for securing an item with a lock, the securement device comprising:

a flexible cable having a first portion and a second portion;

a connector base having a first end opposite a second end, a stepped area being formed on the first end, the stepped area having a back wall, a through hole being formed through the back wall with a transition portion between the back wall and the through hole, a lock extension extending from the second end;

a blocking sleeve surrounding at least a portion of the connector base, the blocking sleeve configured to move relative to the connector base from a blocking position to a non-blocking position;

wherein the connector base selectively connects the first portion and the second portion to form a loop in the flexible cable with the second portion of the flexible cable being inserted through the through hole and extending into the stepped area;

and wherein in the blocking position the blocking sleeve holds the second portion of the flexible cable in a bent configuration within the stepped area, where the second portion is bent about the transition portion to prevent withdrawal of the second portion from the through hole, the lock configured to be attached to the lock extension to prevent the transition of the blocking sleeve from the blocking position to the non-blocking position.

2. The securement device of claim 1, wherein the connector base comprises a first aperture.

3. The securement device of claim 2, wherein at least some of the first portion of the flexible cable is contained with the first aperture, the first portion having an enlarged section that engages the first aperture to block withdrawal of the first portion from the first aperture.

4. The securement device of claim 1, wherein the blocking sleeve holds the second portion of the flexible cable in a single bend about the transition portion.

5. The securement device of claim 1, wherein the connector base and the blocking sleeve are both cylindrical.

6. The securement device of claim 1, wherein the blocking sleeve comprises a locking aperture, the lock extension extending through the blocking sleeve at least when the blocking sleeve is in the blocking position.

7. The securement device of claim 6, wherein the lock extension comprises a shackle aperture.

8. The securement device of claim 7, wherein the lock comprises a shackle extending through the shackle aperture.

9. The securement device of claim 6, wherein the lock extension comprises a locking groove extending circumferentially thereabout.

10. The securement device of claim 9, wherein the lock engages the locking groove.

11. The securement device of claim 6, wherein the blocking sleeve is covering at least a part of the stepped area in the blocking position.

12. The securement device of claim 11, wherein the blocking sleeve further comprises a first clearance aperture and a second clearance aperture, the first portion of the flexible cable being inserted through the first clearance aperture to permit movement of the blocking sleeve relative to the connector base, the second portion of the flexible cable being inserted through the second clearance aperture to permit movement of the blocking sleeve relative to the connector base.

13. The securement device of claim 1, wherein the transition portion between the back wall and the through hole is a corner.

14. A securement device configured for securing an item with a lock, the securement device comprising:

a flexible cable having a first portion and a second portion;

a cylindrical connector base selectively connecting the first portion and the second portion to form a loop in the flexible cable, a cutout being formed in the connector base and being defined by a back wall and a bottom wall, a through hole being formed through the back wall with a transition portion between the back wall and the through hole, a lock extension extending from the connector base;

a blocking sleeve with a cylindrical interior wall surrounding at least a portion of the connector base, the blocking sleeve configured to axially move relative to the connector base from a blocking position to a non-blocking position;

wherein the second portion of the flexible cable is inserted through the through hole and is extending into the cutout;

and wherein in the blocking position the blocking sleeve holds the second portion of the flexible cable in a bent configuration within the cutout, where the second portion is bent about the transition portion to prevent withdrawal of the second portion from the through hole, the lock configured to be attached to the lock extension to prevent the transition of the blocking sleeve from the blocking position to the non-blocking position.

* * * * *